US008573015B2

(12) United States Patent
Otsuka et al.

(10) Patent No.: US 8,573,015 B2
(45) Date of Patent: Nov. 5, 2013

(54) ROLLING MILL AND ROLLING METHOD

(75) Inventors: Hiroyuki Otsuka, Yokohama (JP); Shigeru Tsuzuki, Yokohama (JP); Tsuyoshi Sugiyasu, Yokohama (JP); Tsukasa Matsuzawa, Yokohama (JP); Hajime Ishii, Tokyo (JP); Hisashi Honjou, Yokohama (JP)

(73) Assignee: IHI Corporation (JP)

( * ) Notice: Subject to any disclaimer, the term of this patent is extended or adjusted under 35 U.S.C. 154(b) by 308 days.

(21) Appl. No.: 12/921,969

(22) PCT Filed: Mar. 18, 2009

(86) PCT No.: PCT/JP2009/055282

§ 371 (c)(1),
(2), (4) Date: Sep. 10, 2010

(87) PCT Pub. No.: WO2009/116571

PCT Pub. Date: Sep. 24, 2009

(65) Prior Publication Data

US 2011/0005285 A1 Jan. 13, 2011

(30) Foreign Application Priority Data

Mar. 21, 2008 (JP) ..... P2008-073597

(51) Int. Cl.
*B21B 27/06* (2006.01)

(52) U.S. Cl.
USPC ..... 72/201; 72/8.9; 72/9.1; 72/11.3; 72/12.2; 700/153

(58) Field of Classification Search
USPC ..... 72/8.5, 8.9, 9.1, 11.3, 11.6, 11.7, 12.2, 72/201, 236, 342.2, 342.3, 342.4, 342.5; 700/153, 154
See application file for complete search history.

(56) References Cited

U.S. PATENT DOCUMENTS 4,612,788 A * 9/1986 Kitagawa ..... 72/11.3
4,934,444 A * 6/1990 Frischknecht et al. ..... 164/480
5,212,975 A * 5/1993 Ginzburg ..... 72/43
6,014,881 A * 1/2000 Imanari ..... 72/201
(Continued)

FOREIGN PATENT DOCUMENTS

CN 1846888 A 10/2006
JP 1-224105 9/1989
(Continued)

OTHER PUBLICATIONS

International Search Report and Written Opinion mailed Jun. 16, 2009 in corresponding PCT International Application No. PCT/JP2009/055282.

(Continued)

*Primary Examiner* — Edward Tolan
(74) *Attorney, Agent, or Firm* — Ostrolenk Faber LLP

(57) ABSTRACT

The present invention relates to the providing of a rolling mill that makes it possible to more accurately control the shape of a plate material than has hitherto been possible, and to a rolling method, and is a rolling mill that rolls a plate material using vertical work rolls, and that includes: a coolant jet spray unit that has a plurality of nozzles that are arranged at predetermined intervals in the direction of the rotation axis of the work rolls, and that sprays jets of coolant from the respective nozzles onto the work rolls; a roll temperature estimation unit that estimates a mean temperature of the work rolls; a coolant temperature detection unit that detects a temperature of the coolant; a shape detection unit that detects the shape in the width direction of the rolled plate material; a shape deviation calculation unit that calculates an amount of deviation between a plate material shape detected by the shape detection unit and a target shape; and a shape control unit that controls the shape of the plate material by controlling the spray quantity and/or temperature of the coolant which is sprayed from the coolant jet spray unit based on a difference between the mean temperature of the work rolls and the temperature of the coolant, and on the amount of deviation between the plate material shape and the target shape.

7 Claims, 5 Drawing Sheets

(56) References Cited

U.S. PATENT DOCUMENTS

| | | | | |
|---|---|---|---|---|
| 6,314,776 | B1 * | 11/2001 | Puda | 72/10.1 |
| 6,697,699 | B2 * | 2/2004 | Gramckow et al. | 700/154 |
| 7,181,822 | B2 * | 2/2007 | Ondrovic et al. | 29/527.7 |
| 8,166,785 | B2 * | 5/2012 | Ootsuka et al. | 72/11.7 |

FOREIGN PATENT DOCUMENTS

| | | |
|---|---|---|
| JP | 7-32041 | 2/1995 |
| JP | 9-57311 | 3/1997 |
| JP | 3828784 | 10/2006 |
| JP | 2007-210528 | 8/2007 |

OTHER PUBLICATIONS

Office Action dated Aug. 8, 2012 issued in corresponding Chinese Patent Application No. 200980107221.6 with English translation (13 pages).

* cited by examiner

ROLLING MILL AND ROLLING METHOD

CROSS-REFERENCE TO RELATED APPLICATIONS

The present application is a 35 U.S.C. §§371 national phase conversion of PCT/JP2009/055282, filed Mar. 18, 2009, which claims priority of Japanese Patent Application No. 2008-073597, filed Mar. 21, 2008, the contents of which are incorporated herein by reference. The PCT International Application was published in the Japanese language.

TECHNICAL FIELD

The present invention relates to a rolling mill and a rolling method.

TECHNICAL BACKGROUND

For example, in Patent document 1 (see below) there are described a rolling mill and a rolling method in which, in a rolling mill that rolls a plate material using a pair of vertically aligned work rolls, there are provided a base coolant supply unit that sprays jets of base coolant onto the work rolls, and a spot coolant supply unit that sprays jets of spot coolant onto the work rolls, and in which, based on a temperature difference between the base coolant and the spot coolant, a flow ratio between the base coolant and the spot coolant is set, and the base coolant supply unit and the spot coolant supply unit are controlled such that jets of base coolant and spot coolant are sprayed in this set flow ratio thereby enabling the shape of the plate material in the plate width direction to be controlled. [Patent document 1] Japanese Patent Publication No. 3828784

DISCLOSURE OF THE INVENTION

Problems to be Solved by the Invention

As is described above, in the conventional technology, the shape in the width direction of the plate material is controlled based on a temperature difference between the base coolant and the spot coolant. However, there is a greater effect on shape changes in the plate material which are generated by coolant control from the temperature difference between the work rolls and the coolant rather than from the temperature difference between the base coolant and the spot coolant. For this reason, the above described conventional technology cannot be described as a rolling mill and rolling method that are accurate and effective in controlling the shape of a plate material.

The present invention was conceived in view of the above described circumstances and it is an object thereof to provide a rolling mill and rolling method that make it possible to more accurately control the shape of a plate material than has hitherto been possible.

Means for Solving the Problem

In order to achieve the aforementioned object, the present invention employs the following devices.

That is, (1) The present invention is a rolling mill that rolls a plate material using vertical work rolls, and that includes: a coolant jet spray unit that has a plurality of nozzles that are arranged at predetermined intervals in the direction of the rotation axis of the work rolls, and that sprays jets of coolant from the respective nozzles onto the work rolls; a roll temperature estimation unit that estimates a mean temperature of the work rolls; a coolant temperature detection unit that detects a temperature of the coolant; a shape detection unit that detects the shape in the width direction of the rolled plate material; a shape deviation calculation unit that calculates an amount of deviation between a plate material shape detected by the shape detection unit and a target shape; and a shape control unit that controls the shape of the plate material by controlling the spray quantity and/or temperature of the coolant sprayed from the coolant jet spray unit based on a difference between the mean temperature of the work rolls and the temperature of the coolant, and on the amount of deviation between the plate material shape and the target shape.

(2) Moreover, the present invention is a rolling mill that rolls a plate material using vertical work rolls, and that includes: a base coolant jet spray unit that has a plurality of nozzles that are arranged at predetermined intervals in the direction of the rotation axis of the work rolls, and that sprays jets of base coolant from the respective nozzles onto the work rolls; a spot coolant jet spray unit that has a plurality of nozzles that are arranged at predetermined intervals in the direction of the rotation axis of the work rolls, and that sprays jets of spot coolant from the respective nozzles onto the work rolls; a roll temperature estimation unit that estimates a mean temperature of the work rolls; a base coolant temperature detection unit that detects a temperature of the base coolant; a spot coolant temperature detection unit that detects a temperature of the spot coolant; a shape detection unit that detects the shape in the width direction of the rolled plate material; a shape deviation calculation unit that calculates an amount of deviation between a plate material shape detected by the shape detection unit and a target shape; and a shape control unit that controls the shape of the plate material by controlling at least one of the spray quantity and temperature of the base coolant which is sprayed from the base coolant jet spray unit and the spray quantity and temperature of the spot coolant which is sprayed from the spot coolant jet spray unit based on a difference between the mean temperature of the work rolls and the temperature of the base coolant, and on a difference between the mean temperature of the work rolls and the temperature of the spot coolant, and on the amount of deviation between the plate material shape and the target shape.

(3) In the rolling mill described in the above (1) and (2), it is also possible for the roll temperature estimation unit to be provided with: a motor current detection unit that detects a current value of a motor that causes the work rolls to rotate; and a temperature calculation unit that calculates plate plastic deformation energy based on the current value of the motor, and calculates the mean temperature of the work rolls using the plate plastic deformation energy.

(4) In the rolling mill described in the above (1) through (3), it is also possible for the roll temperature estimation unit to calculate the plate plastic deformation energy based on a predetermined plastic working operational formula, and to calculate the mean temperature of the work rolls using the plate plastic deformation energy.

(5) Moreover, the present invention is a rolling method in which a plate material is rolled by vertical work rolls, and that includes: a coolant jet spray step in which jets of coolant are sprayed onto the work rolls from a plurality of nozzles that are arranged at predetermined intervals in the direction of the rotation axis of the work rolls; a roll temperature estimation step in which a mean temperature of the work rolls is estimated; a coolant temperature detection step in which a temperature of the coolant is detected; a shape detection step in which the shape in the width direction of the rolled plate material is detected; a shape deviation calculation step in which an amount of deviation between a plate material shape detected by the shape detection unit and a target shape is calculated; and a shape control step in which the shape of the plate material is controlled by controlling the spray quantity and/or temperature of the coolant based on a difference between the mean temperature of the work rolls and the temperature of the coolant, and on the amount of deviation between the plate material shape and the target shape.

(6) Moreover, the present invention is a rolling method in which a plate material is rolled by vertical work rolls, and that includes: a base coolant jet spray step in which jets of base coolant are sprayed onto the work rolls from a plurality of nozzles that are arranged at predetermined intervals in the direction of the rotation axis of the work rolls; a spot coolant jet spray step in which jets of spot coolant are sprayed onto the work rolls from a plurality of nozzles that are arranged at predetermined intervals in the direction of the rotation axis of the work rolls; a roll temperature estimation step in which a mean temperature of the work rolls is estimated; a base coolant temperature detection step in which a temperature of the base coolant is detected; a spot coolant temperature detection step in which a temperature of the spot coolant is detected; a shape detection step in which the shape in the width direction of the rolled plate material is detected; a shape deviation calculation step in which an amount of deviation between a plate material shape detected by the shape detection unit and a target shape is calculated; and a shape control step in which the shape of the plate material is controlled by controlling at least one of the spray quantity and temperature of the base coolant and the spray quantity and temperature of the spot coolant based on a difference between the mean temperature of the work rolls and the temperature of the base coolant, and on a difference between the mean temperature of the work rolls and the temperature of the spot coolant, and on the amount of deviation between the plate material shape and the target shape.

Effects of the Invention

According to the present invention, because it is possible to control the shape of a plate material by controlling the spray quantity and/or the temperature of a coolant sprayed onto a work roll based on the temperature difference between the work roll and the coolant, and on the amount of deviation between the plate shape and the target shape, it is possible to more accurately control the shape of a plate material than has hitherto been possible.

DESCRIPTION OF THE REFERENCE NUMERALS

Figure 1:
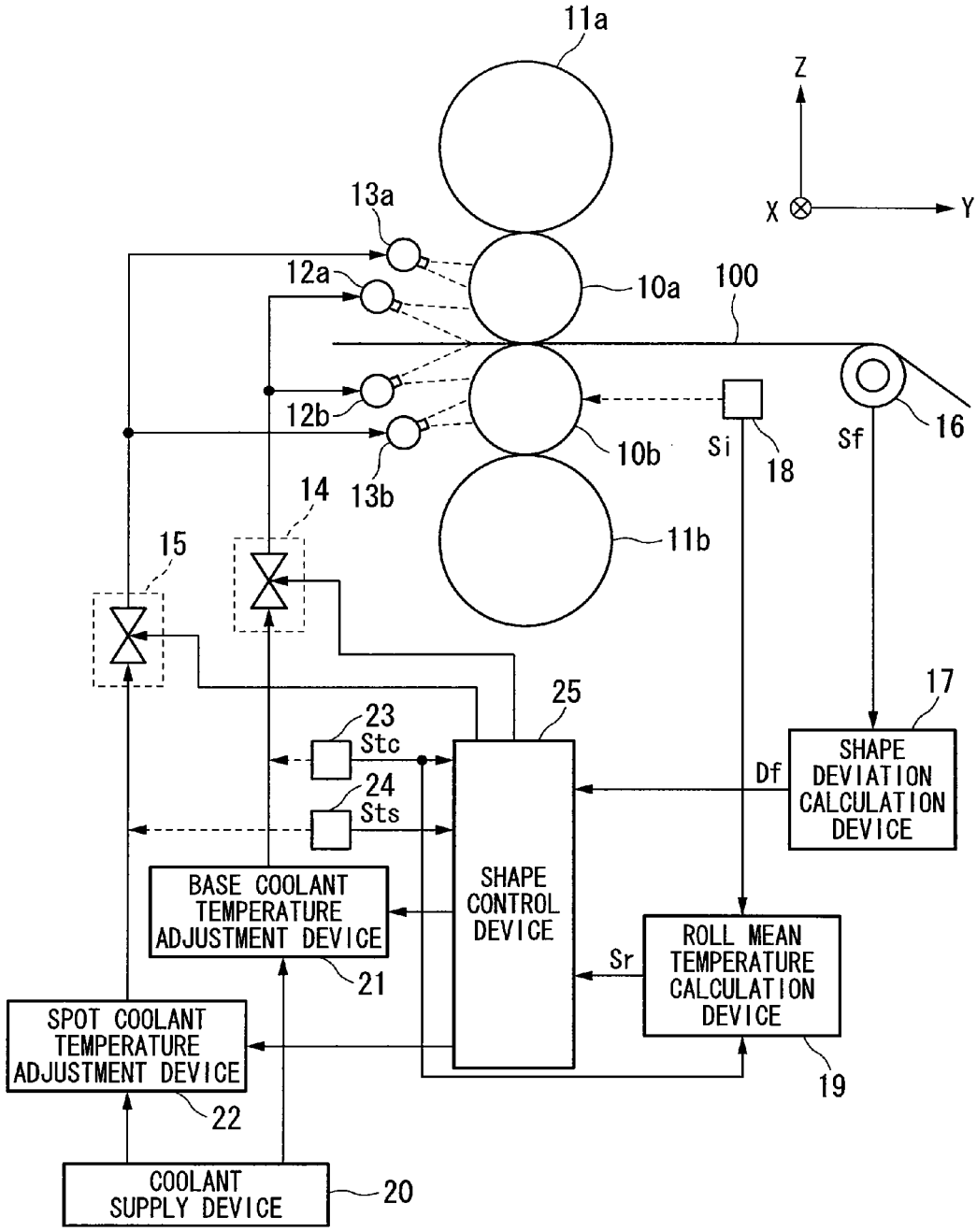
FIG. 1 is a first schematic structural view of a rolling mill according to an embodiment of the present invention.

10*a*, 10*b*. . . Work roll
11*a*, 11*b*. . . Backup roll
12*a*, 12*b*. . . Base coolant spray
13*a*, 13*b*. . . Spot coolant spray
14 . . . Base coolant valve array
15 . . . Spot coolant valve array
16 . . . Shape detection device
17 . . . Shape deviation calculation device
18 . . . Motor current sensor
19 . . . Roll mean temperature calculation device
20 . . . Coolant supply device
21 . . . Base coolant temperature adjustment device
22 . . . Spot coolant temperature adjustment device
23 . . . Base coolant temperature sensor
24 . . . Spot coolant temperature sensor
25 . . . Shape control device
100 . . . Plate Material

BEST EMBODIMENTS FOR IMPLEMENTING THE INVENTION

Hereinafter, an embodiment of the present invention will be described with reference made to the drawings.

Figure 2:
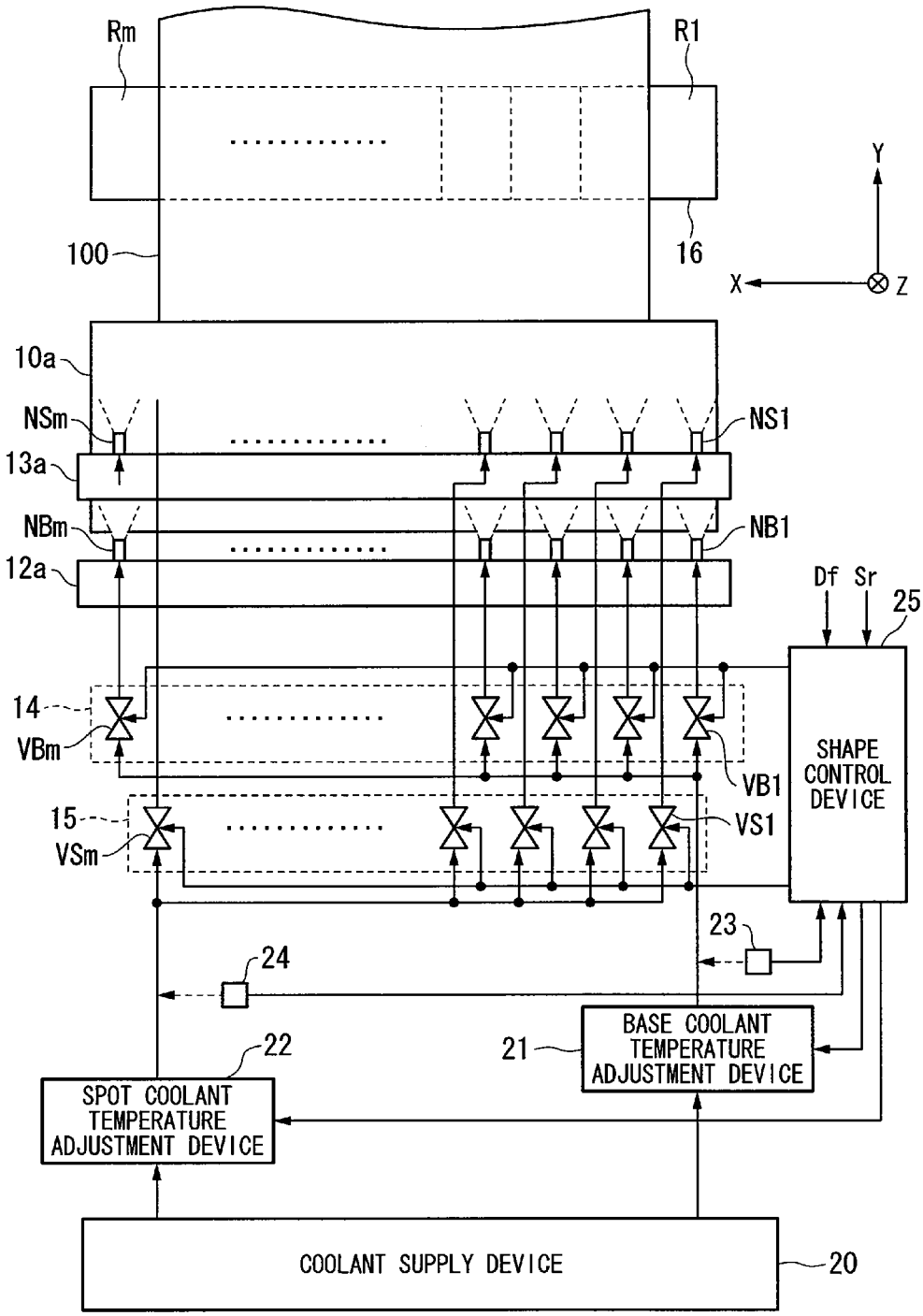
FIG. 2 is a second schematic structural view of a rolling mill according to an embodiment of the present invention.

FIG. 1 and FIG. 2 are schematic structural views of a rolling mill according to the present embodiment. As is shown in FIG. 1 and FIG. 2, a rolling mill according to the present embodiment is formed by the following components, those are, by work rolls 10*a* and 10*b*, backup rolls 11*a* and 11*b*, base coolant sprayers (base coolant jet spray units) 12*a* and 12*b*, spot coolant sprayers (base coolant jet spray units) 13*a* and 13*b*, a base coolant valve array 14, a spot coolant valve array 15, a shape detection device (a shape detection unit) 16, a shape deviation calculation device (a shape deviation calculation unit) 17, a motor current sensor (a motor current detection unit) 18, a roll mean temperature calculation device (a temperature calculation unit) 19, a coolant supply device 20, a base coolant temperature adjustment device 21, a spot coolant temperature adjustment device 22, a base coolant temperature sensor (a base coolant temperature detection unit) 23, a spot coolant temperature sensor (a spot coolant temperature detection unit) 24, and a shape control device (a shape control unit) 25. The symbol 100 indicates a plate material rolled by this rolling mill.

Note that in FIG. 1 and FIG. 2 an XYZ orthogonal coordinate system is set in which the direction of the rotation axis of the work rolls 10*a* and 10*b* (i.e., the plate width direction) is taken as the X-axial direction, the rolling direction of the plate material 100 (namely s, a direction which is perpendicular to the X-axial direction) is taken as the Y-axial direction, and a direction perpendicular to the X and Y planes is taken as the Z-axial direction. FIG. 1 is a typical view in which the work rolls 10*a* and 10*b*, the backup rolls 11*a* and 11*b*, the base coolant sprayers 12*a* and 12*b*, the spot coolant sprayers 13*a* and 13*b,* the shape detection device 16, and the plate material 100 are seen from a side (i.e., from the X-axial direction), while FIG. 2 is a typical view in which the work roll 10*a,* the base coolant sprayer 12*a,* the spot coolant sprayer 13*a,* the shape detection device 16, and the plate material 100 are seen from above (i.e., from the Z-axial direction).

Moreover, in order to simplify the description, in FIG. 1 and FIG. 2, the base coolant valve array 14, the spot coolant valve array 15, the shape deviation calculation device 17, the motor current sensor 18, the roll mean temperature calculation device 19, the coolant supply device 20, the base coolant temperature adjustment device 21, the spot coolant temperature adjustment device 22, the base coolant temperature sensor 23, the spot coolant temperature sensor 24, and the shape control device 25 are positioned without any relation to the XYZ orthogonal coordinate system.

The work rolls 10*a* and 10*b* are a vertically aligned pair of work rolls used for rolling that are provided on the Z axis. The work rolls 10*a* and 10*b* are driven to rotate by a roll motor (not shown), and roll the plate material 100 which is supplied from a plate material supply roll (not shown) by sandwiching the plate material 100 between them. The backup rolls 11*a* and 11*b* are a vertically aligned pair of work roll supporting rolls that are provided on the Z axis. The backup roll 11*a* supports the work roll 10*a* from the top side thereof, and the backup roll 11*b* supports the work roll 10*b* from the bottom side thereof.

The base coolant sprayers 12*a* and 12*b* are a vertically aligned pair of base coolant jet sprayers that are provided on the Z axis. Base coolant is supplied via the base coolant valve array 14 to this pair of base coolant sprayers 12*a* and 12*b.* The base coolant sprayer 12*a* sprays jets of base coolant towards the work roll 10*a,* while the base coolant sprayer 12*b* sprays jets of base coolant towards the work roll 10*b.*

The spot coolant sprayers 13*a* and 13*b* are a vertically aligned pair of spot coolant jet sprayers that are provided on the Z axis. Spot coolant is supplied via the spot coolant valve array 15 to this pair of spot coolant sprayers 13*a* and 13*b.* The spot coolant sprayer 13*a* sprays jets of spot coolant towards the work roll 10*a,* while the spot coolant sprayer 13*b* sprays jets of spot coolant towards the work roll 10*b.* Note that because the spot coolant sprayer 13*a* is provided above the base coolant sprayer 12*a,* spot coolant is sprayed onto the work roll 10*a* above the base coolant. In addition, because the spot coolant sprayer 13*b* is provided below the base coolant sprayer 12*b,* spot coolant is sprayed onto the work roll 10*b* below the base coolant.

The pair of base coolant sprayers 12*a* and 12*b,* the pair of spot coolant sprayers 13*a* and 13*b,* the base coolant valve array 14, and the spot coolant valve array 15 will now be described in detail using FIG. 2. Note that, in FIG. 2, the base coolant sprayer 12*a* and the spot coolant sprayer 13*a* are shown as representative examples of coolant sprayers.

As is shown in FIG. 2, the base coolant sprayer 12*a* has a unit construction and extends in the direction of the rotation axis (namely, in the X-axial direction) of the work roll 10*a,* and m number of nozzles NB1 to NBm that are able to individually spray jets of base coolant are provided at predetermined intervals in this X-axial direction. The base coolant valve array 14 is formed by m number of valves VB1 to VBm that correspond respectively to the aforementioned nozzles NB1 to NBm. The valves VB1 to VBm are electromagnetic valves whose open and closed states are individually controlled by base valve control signals output from the shape control device 25. The valves VB1 to VBm (i.e., the electromagnetic valves) supply base coolant, which is supplied to them via the base coolant temperature adjustment device 21, to their respective corresponding nozzles NB1 to NBm in accordance with the base valve control signals.

In the same way as the base coolant sprayer 12*a,* the spot coolant sprayer 13*a* has a unit construction and extends in the direction of the rotation axis of the work roll 10*a,* and m number of nozzles NS1 to NSm that are able to individually spray jets of spot coolant are provided at predetermined intervals in this X-axial direction. The spot coolant valve array 15 is formed by m number of valves VS1 to VSm that correspond respectively to the aforementioned nozzles NS1 to NSm. The valves VS1 to VSm are electromagnetic valves whose open and closed states are individually controlled by spot valve control signals output from the shape control device 25. The valves VS1 to VSm (i.e., the electromagnetic valves) supply spot coolant, which is supplied to them via the spot coolant temperature adjustment device 22, to their respective corresponding nozzles NS1 to NSm in accordance with the spot valve control signals.

Note that the specific structures of the base coolant sprayer 12*b* and the spot coolant sprayer 13*b* are the same as those of the base coolant sprayer 12*a* and the spot coolant sprayer 13*a.*

The shape detection device 16 is provided on the downstream side from the work rolls 10*a* and 10*b,* and the same number of rotation rotors R1 to Rm as the number of the aforementioned nozzles (i.e., m number) are linked to the shape detection device 16 in the plate width direction (namely, the X-axial direction) so as to place it in contact with the bottom surface of the rolled plate material 100. The shape detection device 16 detects the plate shape in the plate width direction of the rolled plate material 100 using the respective rotation rollers R1 to Rm, and outputs a shape detection signal Sf which shows this detected plate shape to the shape deviation calculation device 17. The shape deviation calculation device 17 calculates the amount of deviation between the detected plate shape and a target plate shaped based on this shape detection signal Sf, and outputs shape deviation data Df which shows this amount of deviation to the shape control device 25.

The motor current sensor 18 detects a current Im flowing to the roll motor (i.e., a motor current) which is driving the work roll 10*b* to rotate, and outputs a motor current detection signal Si that shows this detected motor current Im to the roll mean temperature calculation device 19. The roll mean temperature calculation device 19 calculates a roll mean temperature Tr based on the motor current detection signal Si (namely, the motor current Im) output from the motor current sensor 18, and on a base coolant temperature detection signal Stc (namely, a base coolant temperature Tc) output from the base coolant temperature sensor 23, and outputs a roll mean temperature calculation signal Sr that shows the calculated roll mean temperature Tr to the shape control device 25. Note that the method used to calculate this roll mean temperature Tr is described below.

The coolant supply device 20 supplies base coolant to the base coolant valve array 14 via the base coolant temperature adjustment device 21, and supplies spot coolant to the spot coolant valve array 15 via the spot coolant temperature adjustment device 22. The base coolant temperature adjustment device 21 is provided with both cooling and heating functions, and adjusts the temperature of the base coolant supplied from the coolant supply device 20 in accordance with a base coolant temperature control signal output from the shape control device 25. The spot coolant temperature adjustment device 22 is provided with both cooling and heating functions, and adjusts the temperature of the spot coolant supplied from the coolant supply device 20 in accordance with a spot coolant temperature control signal output from the shape control device 25. Note that the spot coolant temperature Ts is sometimes lower and sometimes higher than the roll mean temperature Tr.

The base coolant temperature sensor 23 is provided between the base coolant temperature adjustment device 21 and the base coolant valve array 14, and detects the temperature of the base coolant. It then outputs the base coolant temperature detection signal Stc which shows the detected base coolant temperature Tc to the roll mean temperature calculation device 19 and to the shape control device 25.

The spot coolant temperature sensor 24 is provided between the spot coolant temperature adjustment device 22 and the spot coolant valve array 15, and detects the temperature of the spot coolant. It then outputs a spot coolant temperature detection signal Sts which shows the detected spot coolant temperature Ts to the shape control device 25.

Based on four information items (namely, the shape deviation data Df, the roll mean temperature calculation signal Sr, the base coolant temperature detection signal Stc, and the spot coolant temperature detection signal Sts), the shape control device 25 controls the shape of the plate material 100 by controlling at least one of the following items such that there is zero shape deviation in the plate width direction of the plate material 100:

- the flow rate of the base coolant supplied to the respective nozzles NB1 to NBm of the base coolant sprayers 12*a* and 12*b* (namely, the base coolant spray quantity of each of the nozzles NB1 to NBm);
- the flow rate of the spot coolant supplied to the respective nozzles NS1 to NSm of the spot coolant sprayers 13*a* and 13*b* (namely, the spot coolant spray quantity of each of the nozzles NS1 to NSm);
- the temperature of the base coolant;
- the temperature of the spot coolant.

When the shape control device 25 is controlling the base coolant spray quantity, it controls the open and closed states of the respective valves VB1 to VBm in the base coolant valve array 14 by outputting base valve control signals.

When the shape control device 25 is controlling the spot coolant spray quantity, it controls the open and closed states of the respective valves VS1 to VSm in the spot coolant valve array 15 by outputting spot valve control signals. When the shape control device 25 is controlling the temperature of the base coolant, it controls the base coolant temperature adjustment device 21 by outputting a base coolant temperature control signal.

When the shape control device 25 is controlling the temperature of the spot coolant, it controls the spot coolant temperature adjustment device 22 by outputting a spot coolant temperature control signal.

Next, operations of the rolling mill according to the present embodiment which is constructed in the manner described above will be described.

Firstly, prior to rolling the plate material 100, the shape control device 25 makes initial settings for the spray quantity and temperature of the base coolant and for the spray quantity and temperature of the spot coolant. Next, by outputting a base valve control signal and a base coolant temperature control signal that cause the base coolant spray quantity and temperature of the aforementioned initial settings to be set, the shape control device 25 controls the open and closed states of the respective valves VB1 to VBm, and also controls the base coolant temperature adjustment device 21.

Moreover, by outputting a spot valve control signal and a spot coolant temperature control signal that cause the spot coolant spray quantity and temperature of the aforementioned initial settings to be set, the shape control device 25 controls the open and closed states of the respective valves VS1 to VSm, and also controls the spot coolant temperature adjustment device 22. By doing this, prior to the commencement of rolling, jets of base coolant are sprayed at the temperature of the initial settings and in the spray quantities of the initial settings from the respective nozzles NB1 to NBm onto the work rolls 10*a* and 10*b*, and jets of spot coolant are also sprayed at the temperature of the initial settings and in the spray quantities of the initial settings from the respective nozzles NS1 to NSm onto the work rolls 10*a* and 10*b*.

Next, the rolling of the plate material 100 by the work rolls 10*a* and 10*b* is begun. When the rolled plate material 100 passes over the shape detection device 16, a shape detection signal Sf which shows the plate shape of the rolled plate material 100 is output from the shape detection device 16 to the shape deviation calculation device 17. Specifically, for example, an elongation difference ratio $\Delta\epsilon_S$ can be used for the shape detection signal Sf which shows this plate shape. This elongation difference ratio $\Delta\epsilon_S$ is commonly used in plate shape evaluations in the field of rolling, and is expressed using the following Formula (1). Note that, in Formula (1), $H_S$ is the wave height in the rolling direction (i.e., in the Y-axial direction) of the rolled plate material 100, and L is the pitch of this wave (see FIG. 3). Hereinafter, this $\Delta\epsilon_S$ is described as the detected elongation difference ratio.

$$\Delta\epsilon_S = H_S/L \tag{1}$$

Figure 3:
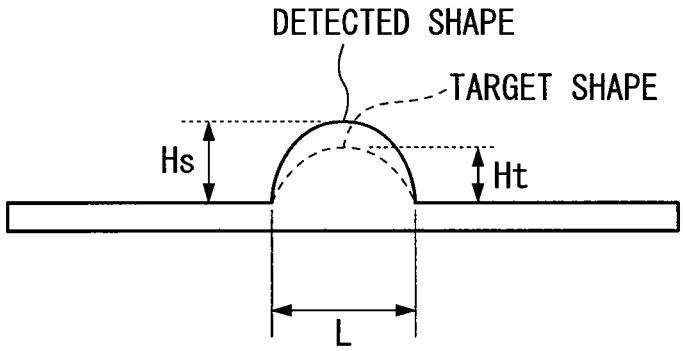
FIG. 3 is a first explanatory view relating to operations of the rolling mill according to an embodiment of the present invention.

Next, based on the aforementioned shape detection signal Sf, the shape deviation calculation device 17 calculates the amount of deviation between the detected plate shape (i.e., the detected elongation difference ratio $\Delta\epsilon_S$) and the target plate shape (i.e., a target elongation difference ratio $\Delta\epsilon_T$), and outputs the shape deviation data Df which shows this calculated deviation amount to the shape control device 25. As is shown in FIG. 3, the target plate shape (i.e., a target elongation difference ratio $\Delta\epsilon_T$) is shown by the following Formula (2), and the shape deviation data Df is shown by the following Formula (3).

$$\Delta\epsilon_T = H_T/L \tag{2}$$

$$Df = \Delta\epsilon_T - \Delta\epsilon_S = (H_T - H_S)/L \tag{3}$$

Moreover, the roll mean temperature calculation device 19 calculates the roll mean temperature Tr based on the motor current detection signal Si (namely, the motor current Im) output from the motor current sensor 18, and on the base coolant temperature detection signal Stc (namely, the base coolant temperature Tc) output from the base coolant temperature sensor 23. Specifically, if the diameters of the work rolls 10*a* and 10*b* are taken as D, if the thermal conductivity is taken as h, if the plate plastic deformation energy generated during the passing of the plate through the work rolls is taken as Es, and if a coefficient is K, then the roll mean temperature Tr is shown by the following Formula (4).

$$Tr = Tc + K \cdot Es/(D \cdot h) \tag{4}$$

Moreover, the plate plastic deformation energy Es is shown by the following Formula (5) if the voltage of the roll motor is taken as Vm and the power factor is taken as cosϕ.

$$Es = Im \cdot Vm \cdot \cos\phi \tag{5}$$

Note that, in the above Formulas (4) and (5), the diameters D of the work rolls 10*a* and 10*b*, the thermal conductivity h, the coefficient K, the roll motor voltage Vm, and the power factor cosϕ are all constants.

Thus, the roll mean temperature calculation device 19 calculates the plate plastic deformation energy Es by assigning the motor current Im shown by the motor current detection signal Si to the above Formula (5). Furthermore, it also calculates the roll mean temperature Tr by assigning the calculated plate plastic deformation energy Es and the base coolant temperature Tc expressed by the base coolant temperature detection signal Stc to the above Formula (4). Then, the roll mean temperature calculation device 19 outputs to the shape control device 25 the roll mean temperature calculation signal Sr that shows the roll mean temperature Tr which was calculated in the manner described above.

In this manner, after the rolling of the plate material 100 has begun, the following four items of information are output from the shape control device 25: the shape deviation data Df is output from the shape deviation calculation device 17, the roll mean temperature calculation signal Sr is output from the roll mean temperature calculation device 19, the base coolant temperature detection signal Stc is output from the base coolant temperature sensor 23, and the spot coolant temperature detection signal Sts is output from the spot coolant temperature sensor 24.

Based on the roll mean temperature calculation signal Sr, the base coolant temperature detection signal Stc, and the base coolant temperature detection signal Stc, the shape control device 25 calculates a temperature difference ΔTc (=Tr−Tc) between the roll mean temperature Tr and the base coolant temperature Tc, and also calculates a temperature difference ΔTs (=Tr−Ts) between the roll mean temperature Tr and the spot coolant temperature Ts. In addition, the shape control device 25 performs shape control on the plate material 100 by controlling the spray quantities and temperatures of the base coolant and spot coolant based on the temperature difference ΔTc, the temperature difference ΔTs, and the shape deviation data Df which were calculated in the manner described above. Note that the temperature difference ΔTs may be a plus value or a minus value.

Hereinafter, specific examples of the shape control of the present embodiment will be described.

(1) EXAMPLE 1

The shape control device 25 of the present example 1 performs shape control on the plate material 100 by controlling the spray quantity and temperature of the spot coolant without changing the spray quantity and temperature of the base coolant from their initial setting values. In this case, the shape control device 25 determines whether localized raised areas (i.e., protruding portions) are present on the surface of the rolled plate material 100, or whether localized pitted areas (i.e., recessed portions) are present on the surface of the rolled plate material 100 based on the shape deviation data Df. Thus, because the shape deviation data Df shows differences between the target plate shape (i.e., the target elongation difference ratio $\Delta\epsilon_T$) and the detected plate shape (i.e., the detected elongation difference ratio $\Delta\epsilon_S$), if the shape deviation data Df<0, then as is shown in FIG. 4A, it is determined that localized recessed portions are present in the plate material surface, and that localized protruding portions are present on the surface of the work roll.

Figure 4A:
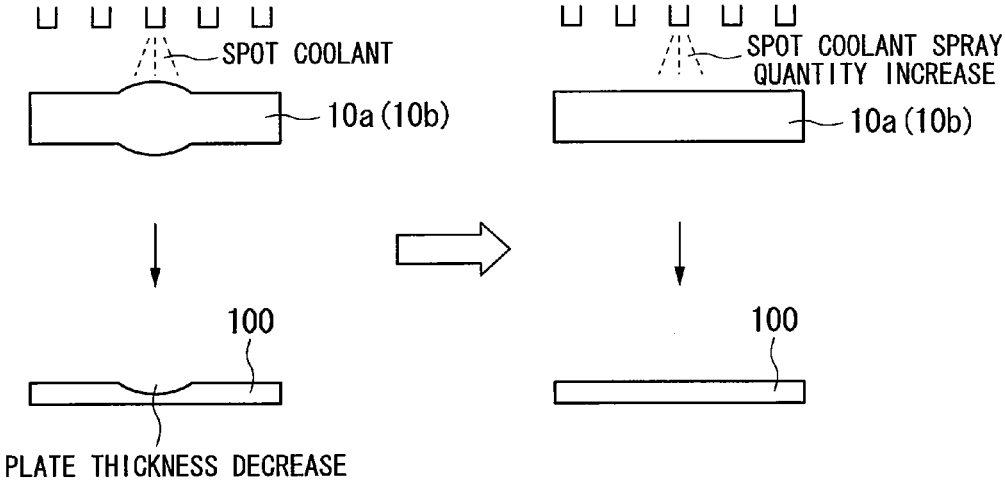
FIG. 4A is a second explanatory view relating to operations of the rolling mill according to an embodiment of the present invention, and shows a recessed portion present locally in a surface of a plate material, and a protruding portion present locally in a surface of a work roll.

If the temperature difference ΔTs>0, then as is shown in FIG. 4A, the shape control device 25 increases the spray quantity (i.e., so as to increase the cooling effect) of spot coolant sprayed from those nozzles of the spot coolant sprayers 13*a* and 13*b* which correspond to the recessed portions in the plate material 100, and thereby causes the protruding portions generated on the work rolls 10*a* and 10*b* to thermally contract. As a result of this, the extent of the rolling carried out on the recessed portions of the surface of the plate material 100 is decreased, and the surface shape thereof is flattened. If the spray quantity of spot coolant reaches the maximum rated value so that it is not possible to increase the spray quantity any further, then the spot coolant temperature adjustment device 22 is controlled so that the temperature of the spot coolant is lowered and the cooling effect is thereby increased.

Figure 4B:
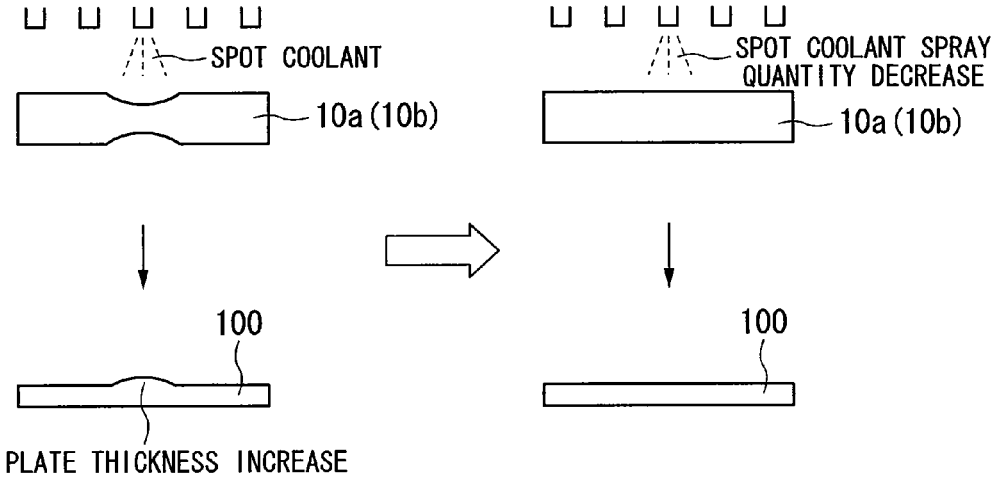
FIG. 4B is a second explanatory view relating to operations of the rolling mill according to an embodiment of the present invention, and shows a protruding portion present locally in a surface of a plate material, and a recessed portion present locally in a surface of a work roll.

In contrast, if the shape deviation data Df>0, then as is shown in FIG. 4B, it is determined that localized protruding portions are present in the plate material surface, and that localized recessed portions are present on the surface of the work roll. In this case, as is shown in FIG. 4B, the shape control device 25 decreases the spray quantity (i.e., so as to decrease the cooling effect) of spot coolant sprayed from those nozzles of the spot coolant sprayers 13*a* and 13*b* which correspond to the protruding portions on the plate material 100, and thereby causes the recessed portions generated in the work rolls 10*a* and 10*b* to thermally expand. As a result of this, the extent of the rolling carried out on the protruding portions of the surface of the plate material 100 is increased, and the surface shape thereof is flattened. If the spray quantity of spot coolant reaches the minimum rated value so that it is not possible to decrease the spray quantity any further, then the spot coolant temperature adjustment device 22 is controlled so that the temperature of the spot coolant is raised.

Figure 5:
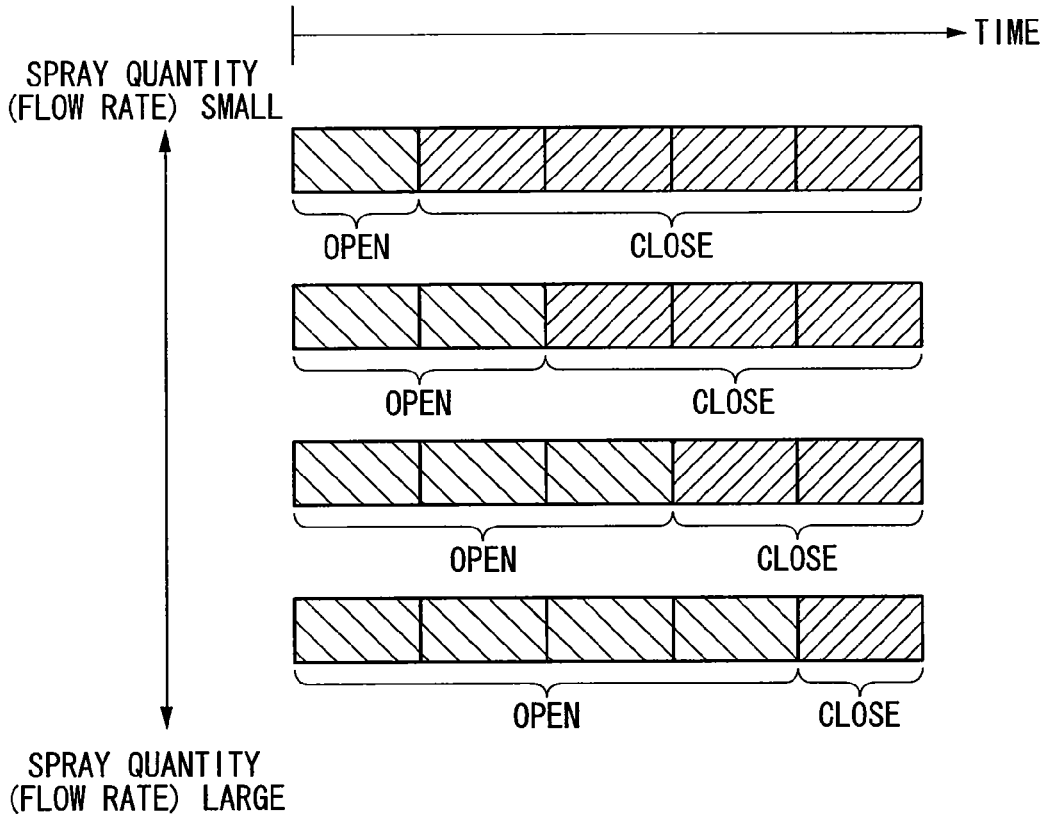
FIG. 5 is a third explanatory view relating to operations of the rolling mill according to an embodiment of the present invention.

Note that the method used to control increases and decreases in the spot coolant spray quantity may be a method in which, as is shown in FIG. 5, the ratio between the valve opening and closing times is controlled. Thus, the spot coolant spray quantity (i.e., flow rate) increases as the proportion of the valve open time relative to the valve closed time is increased. It is also possible to control the spot coolant spray quantity by controlling the opening angle of the valve.

(2) EXAMPLE 2

The shape control device 25 of the present example 2 performs shape control on the plate material 100 by controlling the spray quantity and temperature of the base coolant without changing the spray quantity and temperature of the spot coolant from their initial setting values. Thus, if the temperature difference ΔTc (=Tr−Tc)>0, the shape control device 25 increases the spray quantity of base coolant sprayed from those nozzles of the base coolant sprayers 12*a* and 12*b* which correspond to the recessed portions in the plate material 100, and thereby causes the protruding portions generated on the work rolls 10*a* and 10*b* to thermally contract. As a result of this, the extent of the rolling carried out on the recessed portions of the surface of the plate material 100 is decreased, and the surface shape thereof is flattened. If the spray quantity of base coolant reaches the maximum rated value so that it is not possible to increase the spray quantity any further, then the base coolant temperature adjustment device 21 is controlled so that the temperature of the base coolant is lowered and the cooling effect is thereby increased.

If the temperature difference ΔTc<0, the shape control device 25 increases the spray quantity of base coolant sprayed from those nozzles of the base coolant sprayers 12*a* and 12*b* which correspond to the protruding portions on the plate material 100, and thereby causes the recessed portions generated in the work rolls 10*a* and 10*b* to thermally expand. As a result of this, the extent of the rolling carried out on the protruding portions of the surface of the plate material 100 is increased, and the surface shape thereof is flattened. If the spray quantity of base coolant reaches the maximum rated value so that it is not possible to increase the spray quantity any further, then the base coolant temperature adjustment device 21 is controlled so that the temperature of the base coolant is raised.

(3) EXAMPLE 3

The shape control device 25 of the present example 3 performs shape control on the plate material 100 by controlling both the spray quantity and temperature of the base coolant and the spray quantity and temperature of the spot coolant. In this case, because the temperature difference ΔTc and the temperature difference ΔTs exhibit the same trend, it is possible to perform the recessed/protruding portion determination for the plate shape using either one of these temperature differences. In addition, because this Example 3 is a combination of Example 1 and Example 2, if the temperature difference ΔTc (ΔTs)>0, it is sufficient to control the ratio between the spray quantities (i.e., between flow rates) of base coolant and spot coolant, or to control the ratio between the temperatures of base coolant and spot coolant such that the cooling effect is increased in accordance with the shape deviation amount. Moreover, if the temperature difference ΔTc (ΔTs)<0, it is sufficient to control the ratio between the spray quantities of base coolant and spot coolant, or to control the ratio between the temperatures of base coolant and spot coolant such that the cooling effect is decreased in accordance with the shape deviation amount.

As is described above, according to the rolling mill of the present embodiment, because the shape of a plate material is controlled by controlling at least one of the spray quantity and temperature of a base coolant and the spray quantity and temperature of a spot coolant which are sprayed onto the work rolls 10*a* and 10*b* based on temperature differences between the work rolls 10*a* and 10*b* and the base coolant or spot coolant, or based on the amount of deviation between the plate material shape and a target shape, it is possible to perform more accurate plate shape control than has hitherto been conventionally possible.

Note that the present invention is not limited to the above described embodiments and examples of modifications such as those given below may be considered.

(i) In the above described embodiments, the plate plastic deformation energy Es is calculated from the motor current Im using the above described Formula (5), however, it is also possible to calculate this plate plastic deformation energy Es using the following Formula (6) which is a plastic working operational formula. Note that, in Formula (6), km is a two-dimensional mean deformation resistance (a material-unique value), V is the passage volume, h1 is the exit port thickness, and h2 is the entry port thickness.

$$Es = km \cdot V \cdot ln\,(h1/h2) \quad (6)$$

(ii) In the above described embodiments, the roll mean temperature Tr is calculated using the above described Formula (2), however, the present invention is not limited to this and it is also possible, for example, to measure the radiant heat temperature of either the work roll 10*a* or 10*b* using a radiant heat thermometer, and to estimate the roll mean temperature Tr by performing either temporal or situational averaging processing on the measured radiant heat temperature.

(iii) In the above described embodiments, a type of rolling mill that is provided with two types of coolant jet spray units, that is, the base coolant sprayers 12*a* and 12*b* and the spot coolant sprayers 13*a* and 13*b* is used as an example, however, the present invention is not limited to this type of rolling mill, and may also be applied to a type of rolling mill which is provided with only one type of coolant jet spray unit.

INDUSTRIAL APPLICABILITY

According to the rolling mill of the present invention, because the shape of a plate material is controlled by controlling the spray quantity and/or temperature of a coolant which is sprayed onto work rolls based on temperature differences between the work rolls and the coolant, or based on the amount of deviation between the plate material shape and a target shape, it is possible to perform more accurate plate shape control than has hitherto been conventionally possible.

What is claimed is:

1. A rolling mill that rolls a plate material using vertical work rolls, the rolling mill comprising:

a coolant jet spray unit that includes a plurality of nozzles arranged at predetermined intervals in a direction of a rotation axis of the work rolls, and that sprays jets of coolant from the respective nozzles onto the work rolls;

a roll temperature estimation unit that estimates a mean temperature of the work rolls;

a coolant temperature detection unit that detects a temperature of the coolant;

a shape detection unit that detects a shape in a width direction of the rolled plate material;

a shape deviation calculation unit that calculates an amount of deviation between a plate material shape detected by the shape detection unit and a target shape; and a shape control unit that controls the shape of the plate material by controlling at least one of a spray quantity and a temperature of the coolant sprayed from the coolant jet spray unit based on a difference between the mean temperature of the work rolls and the temperature of the coolant, and on the amount of deviation between the plate material shape and the target shape, wherein the shape control unit is capable of performing a first control mode to control at least one of the spray quantity and the temperature of the coolant so that the coolant cools the work rolls when the detected temperature of the coolant is lower than the mean temperature of the work rolls, and a second control mode to control at least one of the spray quantity and the temperature of the coolant so that the coolant heats the work rolls when the detected temperature of the coolant is higher than the mean temperature of the work rolls, and the shape control unit is configured to perform one of the first and second control modes depending on a result of comparison of the detected temperature of the coolant and the mean temperature of the work rolls.

2. The rolling mill according to claim 1, wherein the roll temperature estimation unit comprises:

a motor current detection unit that detects a current value of a motor that causes the work rolls to rotate; and a temperature calculation unit that calculates plate plastic deformation energy based on the current value of the motor, and calculates the mean temperature of the work rolls using the plate plastic deformation energy.

3. The rolling mill according to claim 1, wherein the roll temperature estimation unit calculates the plate plastic deformation energy based on a predetermined plastic working operational formula, and calculates the mean temperature of the work rolls using the plate plastic deformation energy.

4. A rolling mill that rolls a plate material using vertical work rolls, the rolling mill comprising:

a base coolant jet spray unit that has a plurality of nozzles that are arranged at predetermined intervals in a direction of a rotation axis of the work rolls, and that sprays jets of base coolant from the respective nozzles onto the work rolls;

a spot coolant jet spray unit that has a plurality of nozzles that are arranged at predetermined intervals in the direction of the rotation axis of the work rolls, and that sprays jets of spot coolant from the respective nozzles onto the work rolls;

a roll temperature estimation unit that estimates a mean temperature of the work rolls;

a base coolant temperature detection unit that detects a temperature of the base coolant;

a spot coolant temperature detection unit that detects a temperature of the spot coolant;

a shape detection unit that detects a shape in a width direction of the rolled plate material;

a shape deviation calculation unit that calculates an amount of deviation between a plate material shape detected by the shape detection unit and a target shape; and a shape control unit that controls the shape of the plate material by controlling at least one of a spray quantity and a temperature of the base coolant which is sprayed from the base coolant jet spray unit and a spray quantity and a temperature of the spot coolant which is sprayed from the spot coolant jet spray unit based on a difference between the mean temperature of the work rolls and the temperature of the base coolant, and on a difference between the mean temperature of the work rolls and the temperature of the spot coolant, and on the amount of deviation between the plate material shape and the target shape, wherein the shape control unit is capable of performing a first control mode to control at least one of the spray quantity and the temperature of the base coolant so that the base coolant cools the work rolls when the detected temperature of the base coolant is lower than the mean temperature of the work rolls, and a second control mode to control at least one of the spray quantity and the temperature of the base coolant so that the base coolant heats the work rolls when the detected temperature of the base coolant is higher than the mean temperature of the work rolls, the shape control unit is configured to perform one of the first and second control modes depending on a result of comparison of the detected temperature of the base coolant and the mean temperature of the work rolls, the shape control unit is capable of performing a third control mode to control at least one of the spray quantity and the temperature of the spot coolant so that the spot coolant cools the work rolls when the detected temperature of the spot coolant is lower than the mean temperature of the work rolls, and a fourth control mode to control at least one of the spray quantity and the temperature of the spot coolant so that the spot coolant heats the work rolls when the detected temperature of the spot coolant is higher than the mean temperature of the work rolls, and the shape control unit is configured to perform one of the third and fourth control modes depending on a result of comparison of the detected temperature of the spot coolant and the mean temperature of the work rolls.

5. The rolling mill according to claim 4, wherein the roll temperature estimation unit comprises:

a motor current detection unit that detects a current value of a motor that causes the work rolls to rotate; and a temperature calculation unit that calculates plate plastic deformation energy based on the current value of the motor, and calculates the mean temperature of the work rolls using the plate plastic deformation energy.

6. A rolling method in which a plate material is rolled by vertical work rolls, the rolling method comprising:

a coolant jet spray step in which jets of coolant are sprayed onto the work rolls from a plurality of nozzles that are arranged at predetermined intervals in a direction of a rotation axis of the work rolls;

a roll temperature estimation step in which a mean temperature of the work rolls is estimated;

a coolant temperature detection step in which a temperature of the coolant is detected;

a shape detection step in which a shape in a width direction of the rolled plate material is detected;

a shape deviation calculation step in which an amount of deviation between a plate material shape detected in the shape detection step and a target shape is calculated; and a shape control step in which the shape of the plate material is controlled by controlling at least one of a spray quantity and a temperature of the coolant sprayed in the coolant jet spray step based on a difference between the mean temperature of the work rolls and the temperature of the coolant, and on the amount of deviation between the plate material shape and the target shape, wherein the shape control step includes a first control step in which at least one of the spray quantity and the temperature of the coolant is controlled so that the coolant cools the work rolls when the detected temperature of the coolant is lower than the mean temperature of the work rolls, and a second control step in which at least one of the spray quantity and the temperature of the coolant is controlled so that the coolant heats the work rolls when the detected temperature of the coolant is higher than the mean temperature of the work rolls, and in the shape control step, one of the first and second control steps is performed depending on a result of comparison of the detected temperature of the coolant and the mean temperature of the work rolls.

7. A rolling method in which a plate material is rolled by vertical work rolls, the rolling method comprising:

a base coolant jet spray step in which jets of base coolant are sprayed onto the work rolls from a plurality of nozzles that are arranged at predetermined intervals in a direction of a rotation axis of the work rolls;

a spot coolant jet spray step in which jets of spot coolant are sprayed onto the work rolls from a plurality of nozzles that are arranged at predetermined intervals in the direction of the rotation axis of the work rolls;

a roll temperature estimation step in which a mean temperature of the work rolls is estimated;

a base coolant temperature detection step in which a temperature of the base coolant is detected;

a spot coolant temperature detection step in which a temperature of the spot coolant is detected;

a shape detection step in which a shape in a width direction of the rolled plate material is detected;

a shape deviation calculation step in which an amount of deviation between a plate material shape detected in the shape detection step and a target shape is calculated; and a shape control step in which the shape of the plate material is controlled by controlling at least one of a spray quantity and a temperature of the base coolant sprayed in the base coolant jet spray step and a spray quantity and a temperature of the spot coolant sprayed in the base coolant jet spray step based on a difference between the mean temperature of the work rolls and the temperature of the base coolant, and on a difference between the mean temperature of the work rolls and the temperature of the spot coolant, and on the amount of deviation between the plate material shape and the target shape, wherein the shape control step includes a first control step in which at least one of the spray quantity and the temperature of the base coolant is controlled so that the base coolant cools the work rolls when the detected temperature of the base coolant is lower than the mean temperature of the work rolls, and a second control step in which at least one of the spray quantity and the temperature of the base coolant is controlled so that the base coolant heats the work rolls when the detected temperature of the base coolant is higher than the mean temperature of the work rolls, in the shape control step, one of the first and second control steps is performed depending on a result of comparison of the detected temperature of the base coolant and the mean temperature of the work rolls, the shape control step further includes a third control step in which at least one of the spray quantity and the temperature of the spot coolant is controlled so that the spot coolant cools the work rolls when the detected temperature of the spot coolant is lower than the mean temperature of the work rolls, and a fourth control step in which at least one of the spray quantity and the temperature of the spot coolant is controlled so that the spot coolant heats the work rolls when the detected temperature of the spot coolant is higher than the mean temperature of the work rolls, and in the shape control step, one of the third and fourth control steps is performed depending on a result of comparison of the detected temperature of the spot coolant and the mean temperature of the work rolls.

* * * * *

UNITED STATES PATENT AND TRADEMARK OFFICE

CERTIFICATE OF CORRECTION

PATENT NO. : 8,573,015 B2
APPLICATION NO. : 12/921969
DATED : November 5, 2013
INVENTOR(S) : Otsuka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 351 days.

Signed and Sealed this
Twenty-second Day of September, 2015

Michelle K. Lee

Michelle K. Lee
*Director of the United States Patent and Trademark Office*